US006994616B2

(12) United States Patent
Inagaki

(10) Patent No.: US 6,994,616 B2
(45) Date of Patent: Feb. 7, 2006

(54) GRINDING UNIT FOR GRINDING MACHINES AND MOUNTING METHOD FOR THE SAME

(75) Inventor: Yoshiteru Inagaki, Osaka (JP)

(73) Assignees: Atryz Inaken Co., Ltd., Osaka (JP); Daisho Seiki Corporation, Osaka (JP)

( * ) Notice: Subject to any disclaimer, the term of this patent is extended or adjusted under 35 U.S.C. 154(b) by 0 days.

(21) Appl. No.: 10/156,952

(22) Filed: May 30, 2002

(65) Prior Publication Data

US 2003/0013399 A1 Jan. 16, 2003

(30) Foreign Application Priority Data

Jun. 26, 2001 (JP) ..... 2001-193018

(51) Int. Cl.
*B24D 7/06* (2006.01)

(52) U.S. Cl. ..... 451/548; 451/543

(58) Field of Classification Search ..... 451/548, 451/542, 540, 550, 544, 551; 125/20
See application file for complete search history.

(56) References Cited

U.S. PATENT DOCUMENTS

| | | | | | |
|---|---|---|---|---|---|
| 1,989,215 | A | * | 1/1935 | Seybold | 451/548 |
| 2,084,789 | A | * | 6/1937 | Beebe | 451/548 |
| 2,307,632 | A | * | 1/1943 | Meyer | 451/548 |
| 2,453,748 | A | * | 11/1948 | Fisher et al. | 451/548 |
| 3,524,736 | A | * | 8/1970 | Spencer | 451/548 |
| 4,212,137 | A | * | 7/1980 | Rue | 451/542 |
| 4,910,924 | A | * | 3/1990 | Bouchard et al. | 451/548 |

FOREIGN PATENT DOCUMENTS

| | | | | |
|---|---|---|---|---|
| SU | 986768 | * | 1/1983 | 451/542 |

* cited by examiner

*Primary Examiner*—Robert A. Rose
(74) *Attorney, Agent, or Firm*—Bacon & Thomas PLLC

(57) ABSTRACT

A grinding unit assembly, a plurality of which is placed around a cylinder (12) of a grinding machine. Each assembly comprises a grindstone unit (1) and a metal fixture (16). The grindstone holder (3) has on one side face a positioning cutout (7), and a thinly cut grindstone (2) attached to one end of the grindstone holder (3). The metal fixture (16) has a metal body (17) having a protrusion (18) adapted to fit in the cutout (7) and a locking bolt (21).

5 Claims, 5 Drawing Sheets

GRINDING UNIT FOR GRINDING MACHINES AND MOUNTING METHOD FOR THE SAME

FIELD OF THE INVENTION

The present invention relates to a grinding unit for grinding machines and a method for mounting the same.

BACKGROUND OF THE INVENTION

Grindstones are used in grinding units, whereby not only the grindstones but also a workpiece to be ground revolve during grinding operation. The shape of the grindstones varies depending upon the face and position of a workpiece to be ground. For example, cylindrical surfaces are ground with the faces of revolution of grindstones formed into the disc shape, while flat surfaces are ground by rotating a plural number of rectangular grindstones being arranged in a circle in such a manner that grinding may be effected with an end face of each grindstone.

Regarding the shape of grinding units to be mounted on a grinding machine, in the case of cylindrical grinding, disc grindstones are fixed by a holder and mounted on a grinding wheel spindle, whereas in the surface grinding operation, a plural number of rectangular grindstones are fixed on the circumference of a rotary cylinder attached on the wheel spindle.

FIGS. 4(A), (B) and (C) are a front view (in part) and sectional view and a partly enlarged perspective view illustrating a conventional grinding unit mounted around a cylinder of a grinding machine. Rectangular grindstones 27 are set to a cradle 29 of a cylinder 12A, and wedge-formed metal fixtures 30 are inserted between the two adjacent grindstones 27. When locking bolts 32 are fastened, the wedge 31 is moved toward the center of the cylinder (along the direction of the arrow), while the grindstones 27 are simultaneously forced away right and left, thereby causing the gaps to be narrowed to effect fixing.

All of the rectangular grindstones 27, which are interrelated with the metal fixtures 30, get positioned only after fastening of the locking bolts 32 of the metal fixtures. The number of grindstones mounted on the large-size grinding tool amounts up to 50 or so, and it requires a lot of time and labor to set all of so many grindstones in position, followed by fixing with wedge-shaped fixtures. Such tedious work adversely affects the rate of operation of a grinding machine in question and is undesirable. In addition, the face of each metal fixture protrudes beyond the surfaces of the grindstones, and inevitably interferes with metal fixtures 26 of a workpiece to be ground (refer to FIG. 3).

Since the rectangular grindstone 27 is not resistant to shock, adequate care is required when handling such grindstones. As wear advances, furthermore, such grindstones become difficult to be fixed with wedge-type metal fixtures, if they are oversized relative to the metal fixtures used. In light of the fact that raw materials for grindstones are costly, a method of using grindstones in a non-efficient manner pushes up the machining costs and is undesirable.

FIG. 5 is a side view illustrating the state of use of another conventional grindstone in grinding a boss 25*a* of a disc brake 25. A rectangular grinding unit 27A consisting of angled grindstones 2A bonded to the tip of a grindstone holder 3A are mounted around a rotary cylinder 12A of a grinding machine 11A by use of wedge-type metal fixtures. The angled tip of grindstone 2A that brings about variations in thickness tends to break off, resulting in severe damage to the service life of grindstones 2A.

When the outer face of the wedge-type metal fixture 30 (see FIG. 4), which protrudes beyond the outer face of the grindstone 2A, approaches to a metal fixture 26 of the disc brake 25, their mutual interference (i.e. collision) is inevitable depending upon the positional conditions of the wedge-type metal fixture 30. For this reason, the grinding unit 27A is slanted when used, as shown in FIG. 5.

The object of the present invention is to provide a grinding unit and a method for mounting the grinding unit that have solved the above-mentioned problems.

BRIEF SUMMARY OF THE INVENTION

In the first aspect, the present invention is a grinding unit, a plurality of which is placed around a cylinder of a grinding machine. Each grinding unit comprises a grindstone holder having on one side face at least a positioning cutout, and a thinly cut grindstone attached to one end of the grindstone holder.

In the second aspect, the present invention is a grinding unit assembly, a plurality of which is placed around a cylinder of a grinding machine. Each assembly comprises a grinding unit having a grindstone holder having on one side face at least a positioning cutout and a thinly cut grindstone attached to one end of the grindstone holder, and a metal fixture having a metal body having a protrusion adapted to fit in the cutout and a locking bolt In the third aspect, the present invention is a method for mounting a grinding unit assembly to a cylinder of a grinding machine, comprising the steps of: setting to a cradle of the rotary cylinder a corresponding portion of the grindstone holder having a cutout, engaging the right and left protrusions of a body of the metal fixture individually into the cutouts of two adjacent grindstone holders, compressing the grindstone holders with the protrusions, and fastening the metal fixture with the locking bolts.

Preferably, the outer face of the metal fixture and outer face of a head of the locking bolt are housed inside an outer face of the grindstone holder.

The grinding unit according to the present invention, which consists of thinly cut grindstones fixed through bonding to a grindstone holder, gets the grindstones subjected to forces in the vertical and horizontal directions alone during grinding operation, and therefore eliminates the risk of breaking or tearing, unlike the counterparts consisting of rectangular grindstones. As a result, this can contribute to uniform wearing and efficient utilization of grindstones.

In the grinding unit and the mounting method for the same according to the present invention, a thinly cut grindstone is fixed through bonding to a grindstone holder. This can prevent the grindstones from breaking and tearing, whereby full advantage is taken of cutouts provided on a grindstone holder to suppress metal fixtures from protruding out of the surface of grindstones. In addition, the need for using angled grindstones is eliminated in the corner grinding for root portions of projections and the like. These enable grindstones to wear uniformly and also facilitate the grinding units to be mounted on a grinding machine.

BRIEF DESCRIPTION OF THE DRAWINGS

Some of the object and advantages of the present invention having been stated, others will appear as the description proceeds when considered in conjunction with the accompanying drawings, in which.

DETAILED DESCRIPTION OF THE PREFERRED EMBODIMENT

Figure 1A:
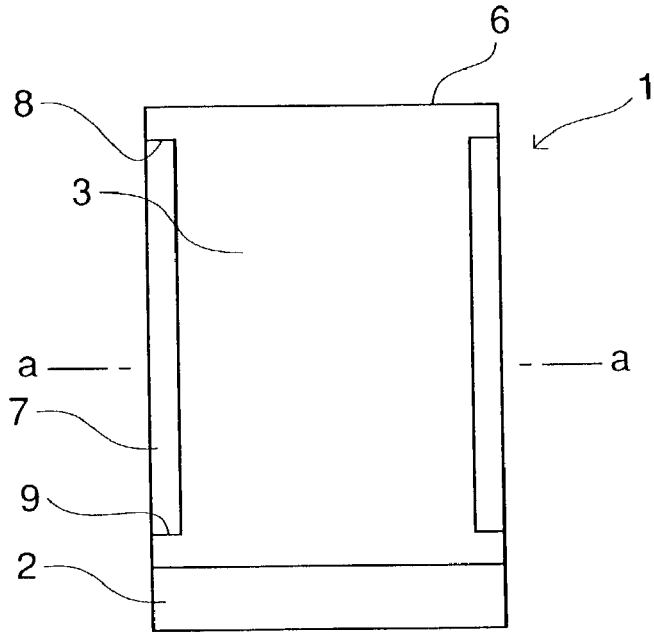
FIGS. 1(A), 1(B) and 1(C) are individually a front view and bottom view of a grinding unit consisting of a grindstone 2 and a grindstone holder 3, and a sectional view taken along the line a—a of FIG. 1(A)
Figure 1B:
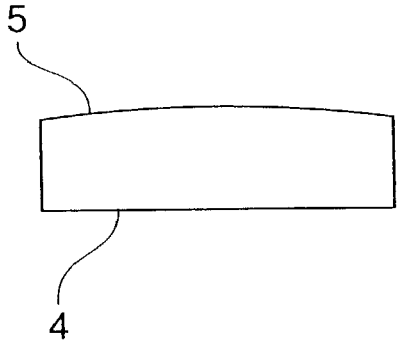
Figure 1C:
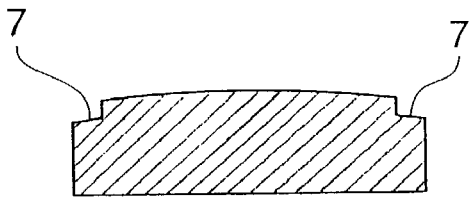

As illustrated in FIGS. 1(A), 1(B) and 1(C), a thinly cut grindstone 2 is bonded to a grindstone holder 3. The external and internal surfaces of the grindstone holder 3 are formed in the arc and plane shapes, respectively. The grindstone 2, which is usually shorter than the grindstone holder 3, is subjected mainly to compressing force in the vertical direction and frictional force in the horizontal direction, with the remaining forces substantially acting to the grindstone holder 3. A larger-sized grindstone extending from the edge of the grindstone holder, however, enables its outer face to carry out corner grinding of projections, etc. (see FIG. 3), thus eliminating the need for the grindstone to be angled.

Figure 4A:
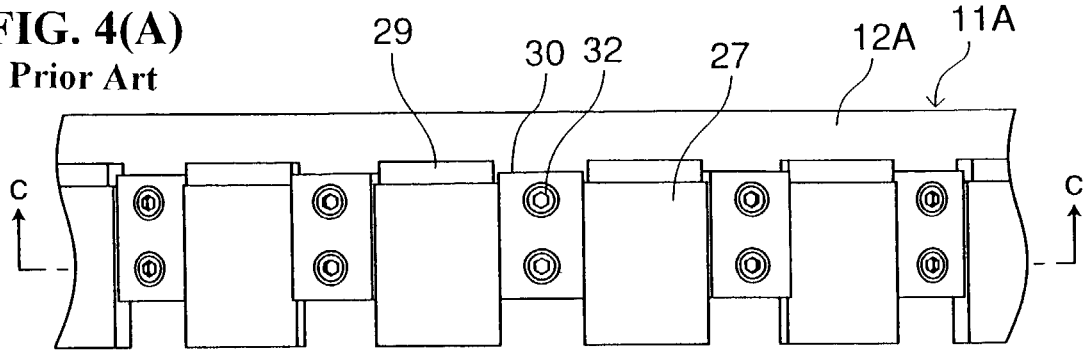
FIG. 4(A) Prior Art
FIGS. 4(A), 4(B) and 4(C), which are concerned with Prior Art 1, are a front view of a grinding machine consisting of grinding units mounted around a rotary cylinder, a sectional view taken along the line c—c of 4(A) and a partly enlarged perspective view of grinding units and metal fixtures, respectively.
Figure 4B:
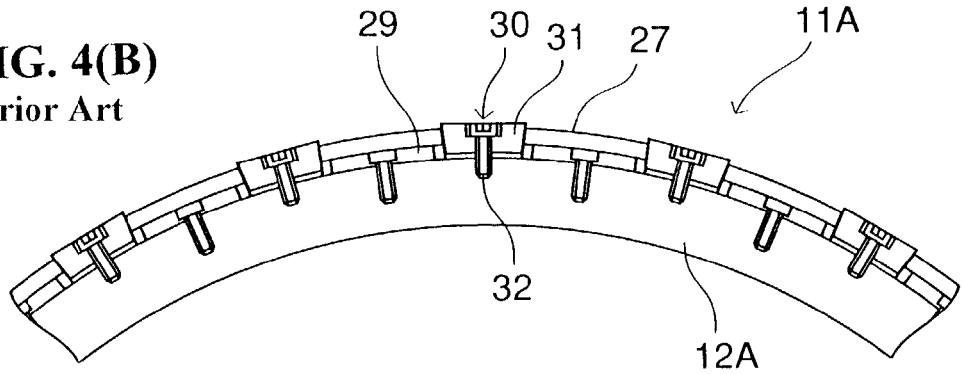
FIG. 4(B) Prior Art
Figure 4C:
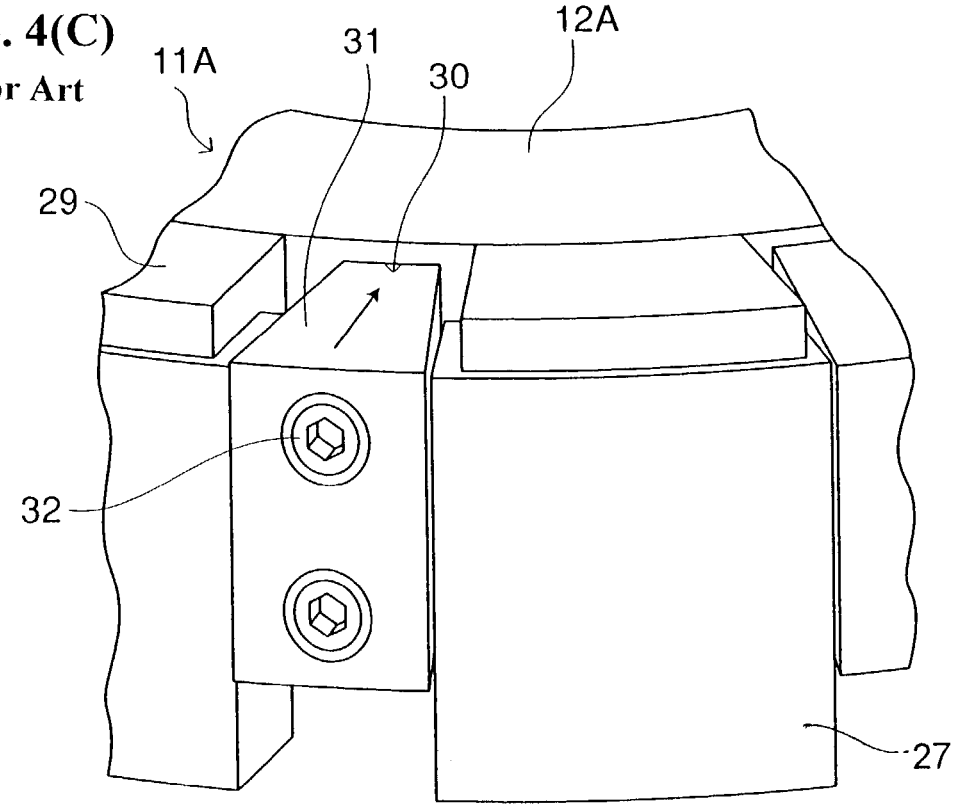
FIG. 4(C) Prior Art
Figure 5:
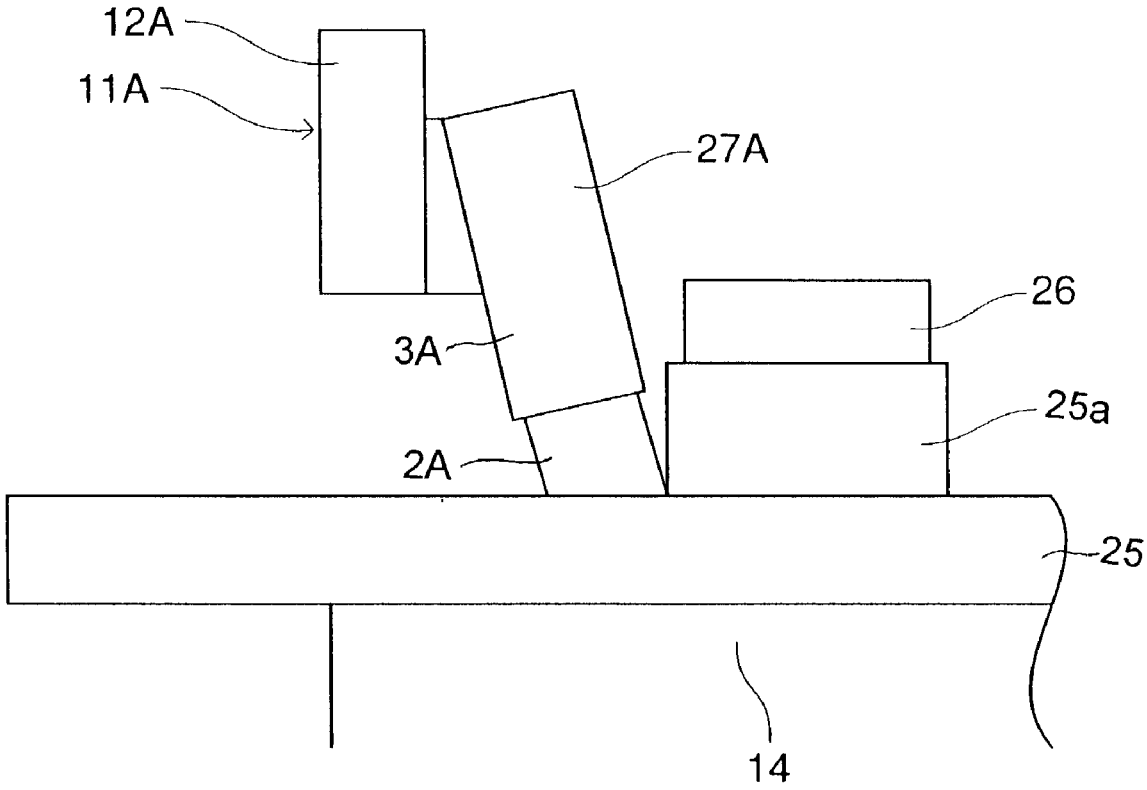
FIG. 5 Prior Art
FIG. 5, which is concerned with Prior Art 2, is a side view illustrating the state of use of a grindstone for grinding bosses of a disc brake having a boss.

The thin grindstone 2 bonded to a grindstone holder 3, as compared with rectangular grinding unit consisting solely of grindstones 27 (see FIG. 4), is more resistant to impact and shock during grinding operation, and has no risk of failing or damaging, thus contributing to uniform grinding work. The grindstone holder 3 may be of any metal plate structures but can be advantageously fabricated by die cast molding to give a high-precision and lightweight structure.

Figure 2A:
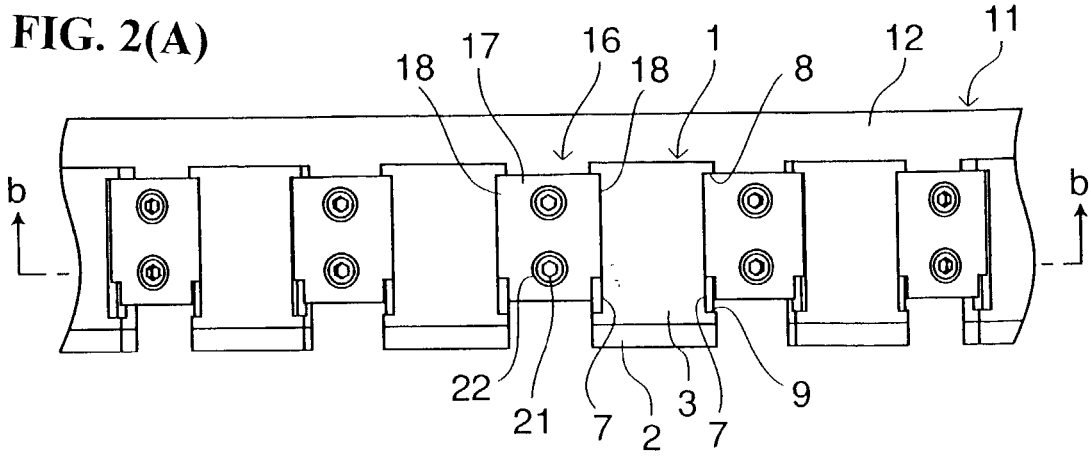
FIGS. 2(A), 2(B) and 2(C) are a front view of a grinding machine consisting of grinding units 3 mounted around a rotary cylinder 12, a sectional view taken along the line b—b of 2(A) and a partly enlarged perspective view of grinding units 3 and metal fixtures 16, respectively.
Figure 2B:
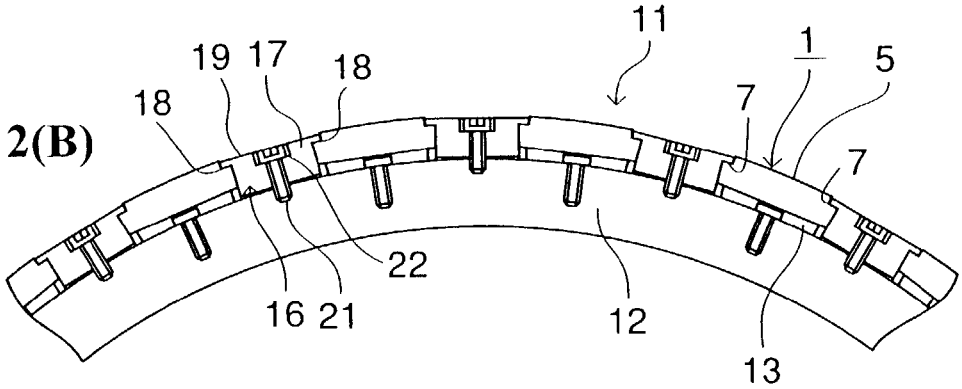
Figure 2C:
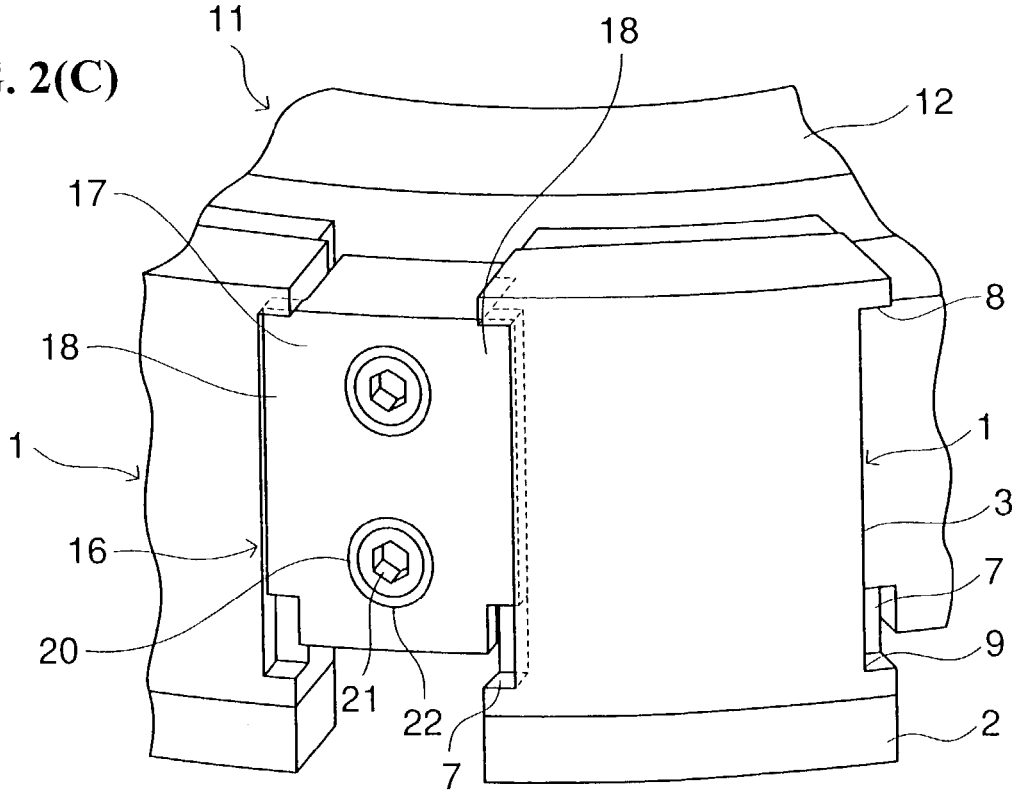

As is shown in FIGS. 2(A), 2(B) and 2(C), surface grinding can be effected by a grinding machine 11 which has a large number of grinding units 1 arranged around a rotary cylinder 12. The grindstones 2 are positioned by applying the inner face 4 of the grindstone holder 3 to the rotary cylinder 12 and setting one end of the projection (or protrusion) 18 of the metal fixture 16 to either upper or lower end 8 or 9 of the cutout 7 provided on the side of adjacent grindstone holder 3. The cutouts 7 have a cutout axial length greater than the axial length of the protrusions 18 of each metal body 17, whereby axial adjustment of each grindstone holder relative to the cylinder 12 is permitted.

Figure 3:
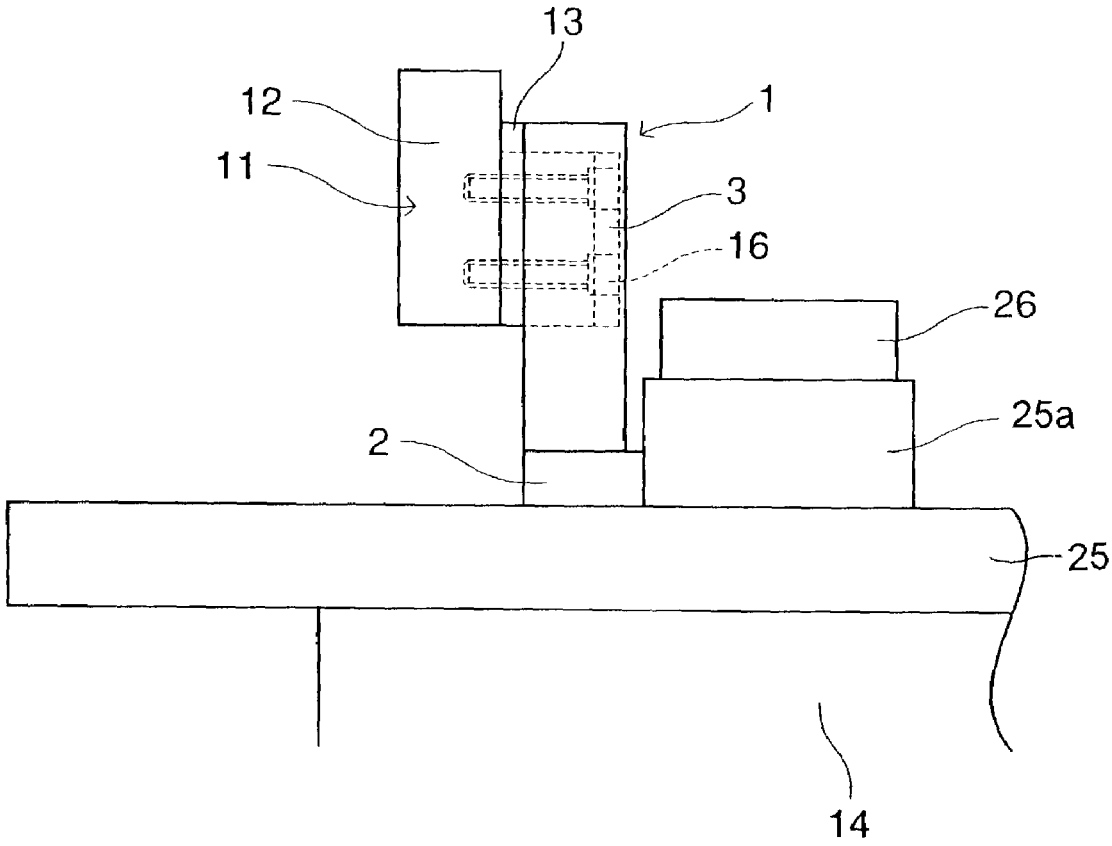
FIG. 3 is a side view of a grindstone in use for grinding a disc brake having a boss.

The grinding unit 1 of the present invention, in which the outer face 19 of the metal fixture 16 is placed inside the outer face of the grindstone holder, is constructed so as to allow the head 22 of the locking bolt 21 not to stand out of the hole 20 of the bolt. By virtue of the above construction, a disc brake 25 with a boss 25*a* as shown in FIG. 3 can be ground without interference of a metal fixture 16 of the grindstone 2 with a metal fixture 26 of the disc brake 25 placed on the working bench 14. As a result, the grinding range is maintained without being adversely affected.

Surface grinding is classified into one-side grinding and double-side grinding. In the former, the grinding unit 1 is only disposed on one side of a workpiece, whereas in the latter, the grinding units are disposed to act on both sides of a workpiece to thereby grind both the face and back sides simultaneously. In the latter case, positioning may be easily made, when the downwardly acting grindstones 2 are placed relative to the upper end 8 of the cutout (as is illustrated in FIG. 2(C)) and the upwardly acting grindstones are placed relative to the lower end 9 of the cutout.

The grindstone holders 3 are positioned by setting to a cradle 13 of the rotary cylinder 12 a corresponding portion of the grindstone holder 3 and then engaging the right and left protrusions 18 of a body 17 of the metal fixture 16 individually into the cutouts of two grindstone holders 3. Then, the grindstone holders 3 are compressed with the protrusions 18, and the locking bolts 21 are fastened to thereby effect provisional fixing of two adjacent grindstone holders 3.

The mounting method of the present invention, which involves compressing the grinding unit 1 from above, facilitates reliable mounting to be effected, as compared with the wedge mounting method mentioned above, thereby realizing a reduction in required length of time for mounting all of the grinding units 1. Vertical force as well as horizontal force owing to rotation mainly act on the grindstones 2 in operation, which makes grindstones undergo uniform wearing, without causing abnormal wearing, thereby contributing to efficient utilization of expensive grindstones.

MERITORIOUS EFFECTS OF THE INVENTION

The grinding units and the mounting method for the grinding units according to the present invention can produce the following effects:

(1) The use of a grindstone holder 3 makes grindstones 2 thinner and is useful in providing grindstones with uniform wear (2) The use of a grindstone holder 3 eliminates the accident of grindstone breaking;

(3) The use of a grindstone holder 3 prolongs the service life of grindstones 2, and enables expensive grindstones to be utilized more efficiently;

(4) The cutout of the grindstone holder 3 maintains the outer face of a metal fixture inside the outer face of a grindstone, thereby getting rid of interference with the metal fixtures of a workpiece and preventing reduction in the range of grinding.

(5) The grinding unit 1 is mounted for fixing by pressing cutouts with the protrusions of metal fixtures in place of pressing directly the grindstone, thereby reducing a length of time required for mounting the grinding unit as compared with the wedge-type metal fixtures (6) No interference takes place among the metal fixtures, thus eliminating the need for angularly shaped grindstones to be used in grinding corners of bosses.

What is claimed is:

1. A grinding unit assembly, comprising a plural number of axial grinding units circumferentially arranged around a cylinder of a grinding machine, each grinding unit including:

a grindstone holder having at least on one side face an axially extending rectangular positioning cutout having a cutout axial length, a thinly cut non-inclined grindstone bonded to an upper or lower end of the grindstone holder;

a metal fixture having a metal body, the metal body having an axially and circumferentially extending protrusion adapted to fit in the positioning cutout, said protrusion being shorter in axial length than said cutout axial length; and a locking bolt threaded into the cylinder and arranged to clamp the metal body against the grindstone holder, said grindstone holder being axially adjustable relative to the cylinder upon loosening of the locking bolt without requiring removal of said protrusion from said positioning cutout.

2. The grinding unit assembly as claimed in claim 1, wherein an outer face of the metal fixture and outer face of a head of the locking bolt are recessed within a peripheral boundary of an outer face of the grindstone holder.

3. A method for mounting multiple grinding units to a rotary cylinder of a grinding machine, comprising the steps of:

providing multiple grinding units, each grinding unit comprising an axially extending grindstone holder having on one side face circumferentially spaced rectangular axially extending positioning cutouts each having an axially extending cutout length, and a thinly cut non-inclined grindstone bonded to the upper or lower end of the grindstone holder, and a metal fixture having a metal body, the metal body having circumferentially opposed axially and circumferentially extending protrusions, each protrusion having an axially extending length that is shorter than the axially extending cutout length and being adapted to fit in a rectangular positioning cutout, and locking bolts threaded into the rotary cylinder;

setting to cradles of the rotary cylinder a corresponding portion of an adjacent pair of grindstone holders having the rectangular positioning cutouts;

engaging the opposed protrusions of the metal body of the metal fixture individually into the rectangular positioned cutouts of the adjacent ones of the grindstone holders;

fastening the metal fixture and compressing the grindstone holders using the protrusions with the locking bolts against the cylinder so that an outer face of the metal fixture and an outer face of a head of each of the locking bolts are recessed within a peripheral boundary of an outer face of the grindstone holder; and axially adjusting the position of the grindstone holders relative to the cylinder by loosening each locking bolt, axially moving the metal holder relative to the cylinder and tightening the locking bolt.

4. A grinding unit assembly according to claim 1, wherein each grindstone holder has two rectangular cut outs each having an axially extending cutout having an axial length, one on each opposing side face, and said metal body including two axially and circumferentially extending circumferentially opposed protrusions having axial lengths shorter than said cutout axial lengths adapted to fit in such cutouts such that an adjacent pair of holders are engageable by the opposite protrusions of a single metal fixture and each holder is axially adjustable relative to the cylinder.

5. A grinding unit assembly according to claim 1, said grindstones each including axial end and side circumferential grinding surfaces.

* * * * *